United States Patent [19]

Koerper

[11] 3,989,859

[45] Nov. 2, 1976

[54] COATING ENTIRE SURFACE OF THREE-DIMENSIONAL ARTICLE WITH HEAT FUSIBLE PLASTIC

[75] Inventor: Phillip E. Koerper, Brookfield, Wis.

[73] Assignee: Koerper Engineering Associates, Inc., Brookfield, Wis.

[22] Filed: Nov. 14, 1974

[21] Appl. No.: 523,716

[52] U.S. Cl. ..... 427/47; 118/308; 118/309; 118/416; 118/DIG. 5; 427/183; 427/184; 427/185; 427/195; 427/233; 427/236; 427/425

[51] Int. Cl.[2] ..... B05D 7/22; B05D 3/12; B05D 1/24

[58] Field of Search ..... 427/185, 195, 181, 182, 427/183, 184, 233, 236, 425, 47; 118/308, 309, 428, 416, 425, DIG. 5

[56] References Cited

UNITED STATES PATENTS

| | | | |
|---|---|---|---|
| 2,362,653 | 11/1944 | McGovern | 118/309 X |
| 3,106,769 | 10/1963 | Goethe et al. | 427/195 |
| 3,247,004 | 4/1966 | Dosser | 118/309 X |
| 3,261,707 | 7/1966 | Korski et al. | 118/406 X |
| 3,411,933 | 11/1968 | Moore | 427/195 X |
| 3,440,078 | 4/1969 | Sharetts | 118/406 X |
| 3,459,578 | 8/1969 | Laulan | 427/183 X |
| 3,649,326 | 3/1972 | Cole et al. | 118/416 |
| 3,661,624 | 5/1972 | Versoy et al. | 427/184 |
| 3,792,683 | 2/1974 | Bragg et al. | 115/DIG. 5 |

*Primary Examiner*—Ronald H. Smith
*Assistant Examiner*—Shrive P. Beck
*Attorney, Agent, or Firm*—Ira Milton Jones

[57] ABSTRACT

A preheated workpiece having a surface with substantially arcuate curvature is supported by rotatable supporting means which has limited contact with said surface. Heat fusible plastic material in finely divided solid form is propelled against all parts of the surface of the workpiece, to be melted by its heat and fuse into an overall coating. During such coating, and thereafter until the material solidifies to substantial hardness, the supporting means is rotated, imparting rotation to the workpiece by its rolling contact therewith, and is cooled to maintain its temperature below the melting point of the material.

10 Claims, 3 Drawing Figures

COATING ENTIRE SURFACE OF THREE-DIMENSIONAL ARTICLE WITH HEAT FUSIBLE PLASTIC

BACKGROUND OF THE INVENTION

This invention relates to the application of plastic coatings to workpieces, and is more particularly concerned with a method and apparatus whereby a three-dimensional workpiece (as distinguished from one that is sheet-like) can be given a coating over its entire surface that is regular and unbroken, with no marks that disclose where the workpiece was supported by aa holder or a tool during the coating process.

The general problem that is solved by the present invention, and some of the more general objects that are achieved by it, are discussed in U.S. Pat. No. 3,573,953, to J. M. Laulan. The Laulan patent contemplates coating a workpiece by immersing it, while heated, in a so-called fluidized bed. In a fluidized bed, heat fusible plastic material in finely divided solid form is held in more or less agitated suspension by air blown upwardly through the bottom wall of a vessel in which the fluidized bed is contained. The airborne plastic particles are brought into contact with the surface of the heated workpiece, upon which they melt and fuse into a coating. The Laulan patent brings out that an article to be coated must be suspended in a fluidized bed for a substantial period of time in order to obtain a complete coating, and that when tongs, hooks or other tools are used for supporting articles in a fluidized bed, such tools leave marks or uncoated spots in the coating.

To avoid such defects, the Laulan patent proposed to allow the workpiece to fall, unsupported, into and partway through the fluidized bed. Laulan taught that different amounts of air should be blown up from different areas of the bottom wall of the fluidized bed vessel, so that the bed therein would have different densities in different parts of the vessel, being less dense and more fluidized over those areas of the bottom wall through which more air was blown. The heated workpiece was to be dropped into a part of the vessel in which the bed was most dense, and its lowermost surface was thus coated as it fell. It landed on the upper end of an inclined grid in the vessel, spaced below the surface of the fluidized bed, and it moved downwardly along the grid by gravity, receiving the rest of its coating as it did so. The workpiece was removed from the fluidized bed by raising the grid.

Laulan did not completely solve the problem posed by the need for supporting the workpiece. At most the process promised a reasonable certainty that the coating would cover all portions of the workpiece, but it afforded no certainty that the finished coating would be unblemished. The workpiece could be completely coated — initially, at least — because all portions of its surface were exposed to impact by plastic particles during the course of its fall through the fluidized bed. But the time during which the workpiece was thus unsupported obviously could not be long enough for accomplishing both coating of the workpiece and substantial hardening of the newly applied coating. At the end of its fall the workpiece encountered the grid, which thereafter served as a holder for the workpiece and which could leave its mark in the soft coating, like any other holder. Furthermore, the collision of the workpiece with the grid presented the possibility of a scraping by which some of the soft coating might be removed, leaving an exposed area on the workpiece.

Even if a complete coverage of the workpiece could be assured with the procedure disclosed by Laulan, and assuming that blemishes in the coating could be somehow avoided, or could be ignored, the thickness of the finished coating could not be controlledly varied to any substantial extent, inasmuch as it depended upon the duration of the very brief period of fall through the fluidized bed.

SUMMARY OF THE INVENTION

With the foregoing considerations in mind, it is the general object of this invention to provide a method and apparatus by which three-dimensional workpieces can be given an even, unbroken and unblemished overall coating of a heat fusible plastic material, and whereby substantial control can be exercised over the amount of such material that is applied to the workpiece, for control of the thickness of the coating that it forms.

Another object of this invention is to provide a method and apparatus whereby a preheated three-dimensional workpiece can be supported all during the time that heat fusible plastic material in finely divided solid form is applied to its entire surface, fuses into an overall coating thereon, and solidifies to substantial hardness, all without leaving any trace or evidence in the hardened coating of the support that has been given to the workpiece, so that the finished coating is regular, unbroken and umblemished.

It is also an object of the invention to provide a method and apparatus for coating a preheated article of the character described with a plastic material which is initially in the form of a heat fusible finely divided solid, which method and apparatus permits heat to be applied to the coated article while it is supported in a manner which assures against leaving any marks or blemishes in the finished coating at locations where the supporting means engaged the article, to assure that the coating material will be sufficiently cured to permit handling of the coated article by the time it is removed from the supporting means.

Another specific object of this invention is to provide a method and apparatus of the character described that is very versatile, in that finely divided solid plastic material which is applied to a heated workpiece for coating the same can be propelled against the workpiece in any of various ways, as by entraining the particulate material in a gas and projecting it from a nozzle, by means of the fluidized bed technique, and even by electrostatic powder coating techniques.

It is another specific object of this invention to provide a method and means for so supporting a heated workpiece during the coating thereof with a heat fusible plastic material and while the coating solidifies that the supporting means for the workpiece leaves no marks or blemishes in the finished coating but, on the contrary, tends to smooth out any unevenness and irregularity in the coating.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

In general, the invention achieves its objectives by supporting the heated workpiece on supporting means having a substantially rounded surface, rotating the supporting means to produce a substantially rolling and constantly shifting contact between the workpiece and the supporting means all during the time that heat curable plastic material in finely divided solid form is applied to the workpiece and thereafter until the material has cured to substantial hardness, and meanwhile maintaining the supporting means at a temperature below that at which the material fuses.

BRIEF DESCRIPTION OF THE DRAWINGS

The accompanying drawings illustrate several complete examples of embodiments of the invention constructed according to the best modes so far devised for the practical application of the principles thereof, and in which.

DESCRIPTION OF THE PREFERRED EMBODIMENTS

Figure 1:
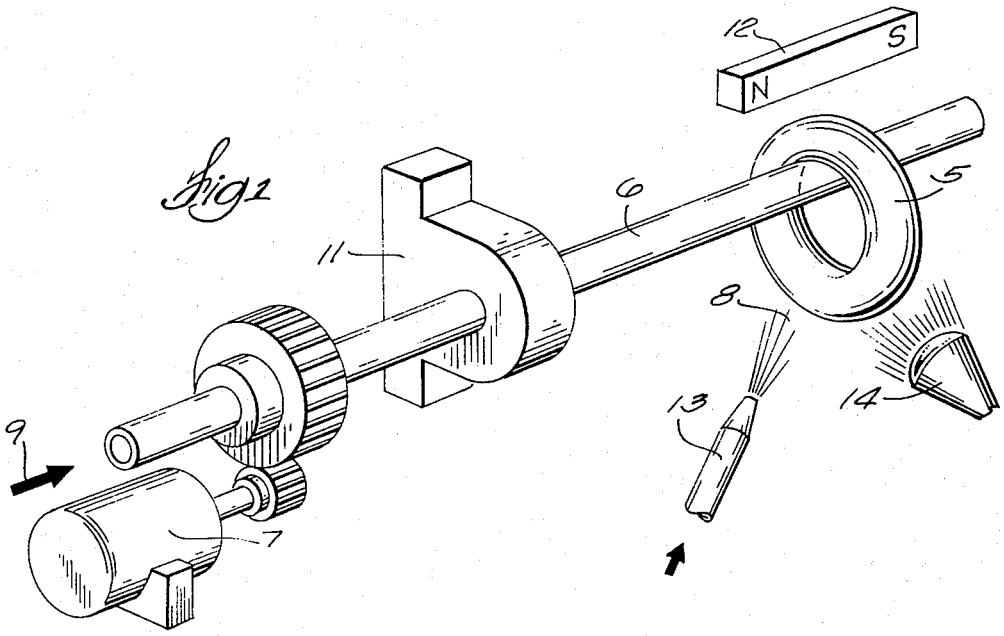
FIG. 1 is a more or less diagrammatic illustration of apparatus embodying the principles of this invention, employed for applying a coating of thermosetting plastic insulation to a cylindrical ring or a toroid intended to serve as the core of a wire-wound electrical device.

Referring now to the accompanying drawings, and considering first the embodiment of the apparatus illustrated in FIG. 1, the method of this invention comprises, in general, the steps of supporting a preheated workpiece 5 by means of rotatable supporting means which, in this apparatus, is a single hollow metal tube 6 and which, at any instant, has only limited rolling engagement with an arcuately curved surface portion of the workpiece; rotating the supporting means about its axis, as with an electric motor 7, to thereby effect rotation of the workpiece and constantly bring new parts of its said surface portion into rolling engagement with the supporting means; propelling solid but finely divided heat fusible plastic material 8 against all portions of the surface of the workpiece, whereby the impinging plastic particles are converted by the heat of the workpiece into an unbroken flowable coating which fuses onto the workpiece and quickly solidifies; and cooling the supporting means, as by circulating through it a cold fluid medium from a source depicted by the arrow 9 in FIG. 1, to prevent the plastic material from fusing onto the supporting means even though the latter tends to be heated by the heated workpiece that it supports.

Before explaining the method in more detail, it should be pointed out that the invention lends itself to practice with workpieces that are three-dimensional (as distinguished from essentially two-dimensional plate-like and sheet-like articles) and with workpieces that are further characterized by at least one accessible surface portion that curves through a substantial arc. Said surface portion is the one that is to be rollingly engaged by the rotatable work supporting means. The arc of curvature of that surface portion need not be of uniform radius (e.i., it need not be an arc of a true circle) but, instead, it can be an oval or elliptical arc or the like. Nor is it necessary that said surface portion have true curvature, so long as it has effective curvature as in the case of a polygon with many sides or a polygon with rounded corners. The criterion for such effective curvature is that the workpiece can be rotated by causing that surface portion of it to have rolling engagement with rotating work supporting means.

Where said arcuately curved surface portion of the workpiece defines a closed curve, as in the case of the inner surface of a ring or the outer surface of a cylinder, the workpiece can be rotated through a full 360° by its rolling engagement with the work supporting means rotating in one direction. However, the method can be accommodated to a workpiece having an accessible arcuate surface which does not define a closed curve but which has substantial extent in the direction of its curvature. In that case, the direction of rotation of thet work supporting means must be periodically reversed, so that its rolling engagement with the workpiece imparts oscillatory rotation to the latter. In any event the supporting means should not be permitted to contact workpiece surface portions other than the arcuately curved one, to ensure that it will have only rolling engagement with the workpiece.

As already indicated, the curved workpiece surface that is to be engaged by the rotating work supporting means can be either an external one or an internal one, but if it is an internal one, it must open relatively unrestrictedly to the exterior of the article.

In FIG. 1, the workpiece 5 is illustrated as a toroid, by way of exemplifying the application of the method to any form of workpiece which has an internal arcuate surface portion. The iternal surface of a toroid is of course a closed curve of uniform radius.

In this case the rotatable work supporting means, as already explained, is a single elongated horizontally disposed cylindrical metal tube 6 journalled in a bearing block 11 from which its work supporting portion projects cantilever fashion. The outside diameter of the tube 6 is substantially smaller than the inside diameter of the workpiece, and because of its cantilevered support, the toroidal workpiece can be readily slipped over its unsupported outer end.

If the workpiece is a true toroid, as shown in FIG. 1, its inner surface contacts the supporting rod at a single point, but if the workpiece is a ring having a cylindrical inner surface, the supporting rod would have line contact with the inner surface of the ring. As the work supporting rod rotates and imparts rotation to the workpiece, the point or the line of contact is in effect constantly moved around the workpiece.

The workpiece must be prevented from slipping off of the supporting tube and preferably should be confined against axial movement relative thereto, but such confinement must be effected without contact with the workpiece, other than its rolling engagement with the work support. As shown in FIG. 1, wherein the workpiece 5 is assumed to be toroidal winding core of magnetic material, axial displacement of the workpiece is prevented by establishing a magnetic field around the zone in which the workpiece is placed on the work support. For purposes of illustration a bar magnet 12 mounted in fixed relation to and in juxtaposition to the work support generates the magnetic field. Obviously, for the magnetic field to be effective on the workpiece, the supporting tube 6 must be formed of nonmagnetic material as for instance, brass.

In the particular situation illustrated in FIG. 1, powdered plastic material, entrained in air, is discharged from a nozzle 13 that is assumed to be manually held for manipulation to various positions and orientations so that an even coatiing of the plastic material can be sprayed onto all portions of the surface of the workpiece. It is also assumed that the workpiece illustrated in FIG. 1 is being coated with a thermosetting material which melts under the influence of the retained heat of the preheated workpiece, and which must remain hot after spraying is completed, for a long enough time to assure that the coating material will be sufficiently polymerized or cured before it is removed from the supporting tube 6, to allow the coated part to be handled without disturbing its coating. Complete polymerization or curing of the coating material is accomplished in a subsequent conventional baking operation.

To ensure that sufficient heat will be available for the preliminary curing of the plastic, without the need for preheating the workpiece to an excessively high temperature, the workpiece can be subjected to supplemental heating for a time after the coating operation has been completed, as by means of an infrared lamp 14. Where the coating material is of the type that produces a better coating if it is slightly liquified before it contacts the heated surface being coated, the supplemental heating can take place while the coating material is being applied to the workpiece.

The work supporting member receives heat from the preheated workpiece as well as from any supplemental heating that may be employed, but its temperature must be kept below the melting point of the plastic to prevent plastic from adhering to it. It can be cooled in any suitable manner that does not interfere with its rotation. Where the work supporting means is a hollow tube 6, as in FIG. 1 or a pair of hollow tubes 6' as in FIG. 2, the needed cooling can be effected in the manner already mentioned, i.e. by passing a cold heat absorbing medium — as, for instance, carbon dioxide — through the tube or tubes. Since such gas is harmless, it can be vented to the atmosphere after passing through the tubes or tubes.

Figure 3:
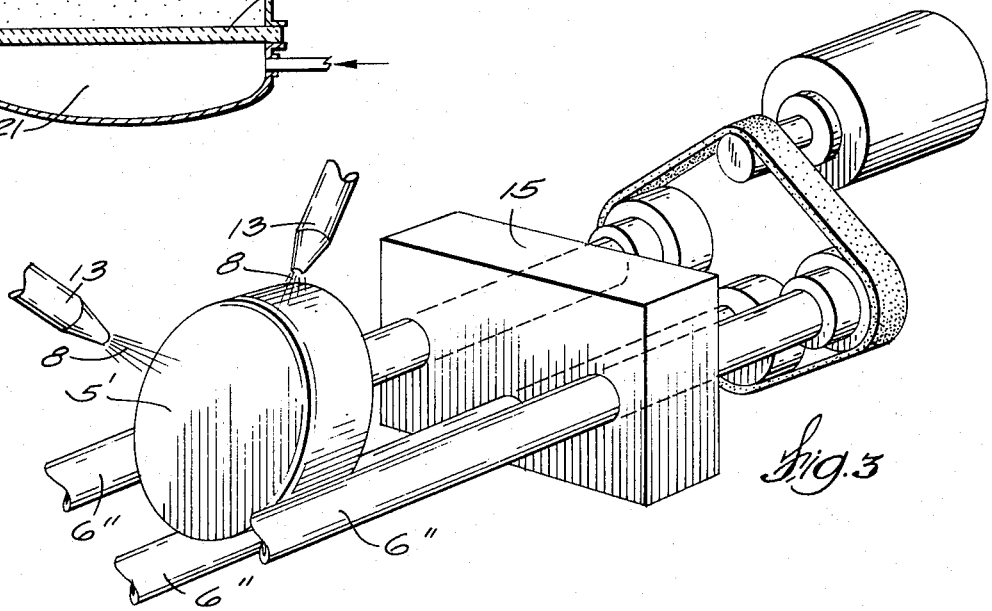
FIG. 3 illustrates diagrammatically another application of the principles of this invention, for coating a solid workpiece that has an elliptical cross-section of substantial eccentricity.

In the apparatus illustrated in FIG. 3 where the work supporting means is in the form of three solid metal rods 6'', the cooling can be achieved by making the bearing block 15 in which these rods are journalled a cold heat sink.

Because the temperature of the work supporting means is maintained below the melting point of the plastic material, plastic particles will not adhere to it as they do to the heated workpiece. As a plastic coating builds up on the workpiece and rotation of the workpiece brings its coated areas into contact with the work supporting member, the low temperature of the supporting member again prevents it from picking up or disturbing the molten plastic on the workpiece. It might be conjectured that plastic in the immediate vicinity of the point or line of contact is hardened into a skin by the low temperature of the supporting member, and that such solidified or near-solidified plastic would naturally have no tendency to adhere to the supporting member. However, it has been found that even a plastic which requires a curing interval for achieving hardening and which is not hardened by mere cooling does not adhere to a chilled rotating supporting member. It seems more likely, therefore, that the plastic does not adhere to the supporting means because of the cohesiveness of the plastic and its preference for adhereing to a hot surface, plus the fact that there is no disruption of its surface tension during the brief time during which the work support engages any particular part of it, owing to rotation of the work support and its rolling engagement with the workpiece.

Because the work supporting member does not pick up any of the plastic, and is in constant motion relative to it, it leaves no marks in the plastic coating. There may be some momentary deformation of the soft plastic by the work supporting means, due to the limited amount of surface area that is carrying the weight of the workpiece. In fact it appears that the supporting member throws up a small wave of the plastic ahead of itself in the direction of workpiece rotation, somewhat like the small wave of soft asphalt that forms in front of the roller of a "steamroller." But the plastic in any particular part of the coating tends to restore itself to a uniform thickness as the point or line of contact passes beyond it. Moreover, previously existing irregularities in the thickness of the coating tend to be evened, steamroller fashion, by the rolling engagement between the workpiece and the supporting means.

Figure 2:
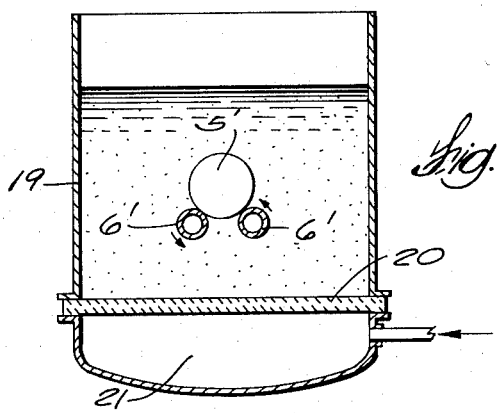
FIG. 2 is a diagrammatic illustration of the principles of this invention applied to the coating of a solid cylindrical workpiece with the use of a fluidized bed.

FIG. 2 illustrates the application of the invention to the coating of a solid workpiece 5' in the form of a cylinder, having an external cylindrical surface which defines a closed curve — in rolling engagement with the work supporting means. In this case, the rotatable work supporting means comprises a pair of elongated cylindrical tubes 6' which have their axes horizontal and parallel and which are spaced apart by a distance less than the diameter of the workpiece. The workpiece is more or less cradled between the tubes 6', with its axis parallel to theirs and with each of the two tubes making line contact with the cylindrical surface of the workpiece. Drive means (not shown) drives the supporting tubes 6' for rotation about their respective fixed axes, both in the same direction and at equal circumferential speeds, so that they have substantially frictionless rolling contact with the workpiece. Since the tubes 6' can be supported at both ends, the coolig fluid — such as carbondioxide gas, or even cold water — can be circulated through them to prevent adhesion thereto of the plastic coating material.

Since the coating material, in that embodiment of the invention depicted in FIG. 2, is in the form of a fluidized bed, the work supporting tubes 6' are immersed therein at a level to assure engagement of the coating material with the entire surface of the preheated workpiece when the latter is lowered onto the rotating supporting means. While complete immersion — as illustrated in FIG. 2 — is probably the preferred way of obtaining such complete coating engagement, the desired results will also be had even if the workpiece is not fully immersed, since by virtue of its rolling engagement with the supporting tubes, all portions of the workpiece will be immersed at one time or another.

The fluidized bed comprises a quantity of pulverized plastic material contained in a vessel 19 having a porous bottom wall 20 through which pressurized air enters the vessel from a plenum chamber 21 therebelow. The air moving upwardly in the vessel 19 more or less levitates the particles of the plastic material and thereby constantly brings fresh particles to the hot surface portions of the workpiece.

Insofar as there may be slightly different concentrations of plastic particles at different places in the fluidized bed, such density variations tend to be compensated for by the rotation of the workpiece, which ensures that plastic will be uniformly applied to all portions of the workpiece surface, including its flat end surfaces.

Again, the plastic coating on the workpiece is not broken or defaded by the cooled and rotating work supporting members, but, instead, their rolling engagement with the cylindrical surface of the workpiece makes for a uniform thickness of the coating thereon. The workpiece can remain on the work supporting members, with the latter kept in rotation, until the coating is hard enough to withstand handling.

FIG. 3 illustrates the application of the method of this invention to the coating of a workpiece 5'' that has an elliptical cross-section of considerable eccentricity. In this case, if only two supporting members carried the workpiece, as in the FIG. 2 apparatus, the workpiece would either fall between the supporting members or tumble off of them; and therefore the work supporting means in this case comprises three cylindrical supporting rods 6'' that have parallel horizontally extending axes. Two of these rods have their axes in a common horizontal plane, and the third one lines below and between them. The spacing between the two upper supporting rods is greater than the narrower dimension of the ellipse but less than its wider dimension; and the distance between the lower supporting rod and each of the upper ones is less than the narrower dimension of the ellipse. The three supporting rods rotate about their respective fixed axes, all in the same direction.

During most of the course of one of its rotations the illustrated workpiece will be rollingly engaged by only two of the three supporting rods, and from time to time it will rotatingly tumble to a slight extent as its drops away from engagement with one of two rods supporting it and into engagement with the third one. However, such tumbling would correspond to only a tiny fall, and therefore the workpiece would engage the third member with an impact force so light that even a comparatively soft coating would be unlikely to sustain any appreciable dent as a result of it. Furthermore, if the coating were indented to any noticeable extent by such an impact, the dent would be rolled out almost immediately as the dented portion came into rolling engagement with another supporting member. Although all three supporting members can be cooled in any suitable manner, in the structure shown in FIG. 3 the cooling is accomplished, as already noted, by using the bearing block 15 in which they are journalled as a cold heat sink.

In certain types of powder coating processes now widely used, particles moving towards a workpiece are electrically charged with a high voltage source, and the workpiece is given a charge opposite to that on the particles, by grounding it. The particles are thus electrostatically attracted to the workpiece.

In a variant form of such electrostatic coating, the particles in a fluidized bed receive their charge from the air that levitates them, such air being charged as it enters the bed. It will be evident that the method and apparatus of this invention lends itself well to all such electrostatic coating processes, inasmuch as the workpiece can be grounded by reason of its rolling engagement with grounded work supporting means.

While the different embodiments of the invention illustrated in the drawings and described with respect thereto deal with a rigid bodied workpiece, it should be understood that the invention is also applicable to the coating of products and workpieces that are not rigid. To illustrate, significant advantages flow from the use of this invention in the coating of wire. In the conventional wire-coating procedure, after passing through the coating zone, the wire travels upwardly through a curing oven. Since proper curing of the resin coating requires it to be subjected to the curing heat for an appreciable time — often longer than 60 seconds — the maintenance of acceptable production rates demands that the wire travel at least 60 feet per minute. Hence the curing oven had to be very tall in order for the resin to be fully cured by the time the wire left the curing oven.

This invention enables the resin to be cured in an oven not nearly as tall as conventional practice required, since it makes it possible to have the wire travel up and down along a plurality of parallel vertical paths and thereby allows the wire to remain in the curing oven for the required time despite a very substantial reduction in the height of the oven.

This is done by entraining the wire over vertically spaced pulleys or sheaves located in the oven and cooled to a temperature low enough to preclude adhesion of the resin thereto. The transient momentary contact the wire has with the cooled pulleys or sheaves has no deleterious effect upon the curing resin and, if anything, results in a desirable ironing or smoothing action.

From the foregoing description taken with the accompanying drawings, it will be apparent that this invention provides a simple, facile and inexpensive method and apparatus for applying to the surface of a three-dimensional workpiece an unbroken and umblemished overall coating of a plastic material that is initially in the form of finely divided heat fusible solid particles. It will also be apparent that the method and apparatus of this invention can be used with three-dimensional workpieces of many and various configurations, and with both thermosetting and thermoplastic coating materials.

Those skilled in the art will appreciate that the invention can be embodied in forms other than as hereindisclosed for purposes of illustration.

The invention is defined by the following claims. enough

I claim:

1. A method of applying to a ring-like metal core member for a wire wound electrical component a smooth, unmarked and unbroken coating of insulation that uninterruptedly covers all surface portions of the core member, said method comprising:

A. providing an elongated substantially cylindrical supporting member that has a diameter substantially smaller than the inside diameter of the core member;

B. rotatably supporting said elongated substantially cylindrical supporting member at only one end thereof with its axis substantially horizontal;

C. preheating the core member;

D. slipping the preheated core member onto said supporting member from its unsupported end, and allowing the core member to hang on the supporting member with only an inner surface portion of the core member in contact with the supporting member;

E. rotating said supporting member about its axis to thereby impart rotation to the core member and constantly change the location on the inner surface of the core member of the interface between it and the supporting member;

F. while said members are rotating, applying a heat fusible plastic material in finely divided solid form to the entire surface of the core member, which upon contact with said surface melts and fuses thereto;

G. abstracting heat from the supporting member to maintain it at a temperature below that at which the fusible material melts; and H. continuing to rotate the supporting member, with the core member hanging thereon, until the coating of fused material on the core member has attained substantial hardness.

2. The method of claim 1, further characterized by:

while the core member is hanging on the supporting member, exerting upon the core member a magnetic force that substantially restrains it against motion in directions axially of the supporting member.

3. The method of claim 1, wherein said plastic material is a thermosetting resinous material, and further characterized by:

directing heat from a source thereof onto the coated core member to cure its coating of thermosetting resinous material.

4. A method whereby a plastic material which is initially in heat fusible finely divided solid form and which, after fusion, heat cures to substantial hardness, can be applied to a curved surface portion of a heated workpiece and formed into a coating which covers the whole of said surface portion without break or blemish even though, during fusion and curing of said material, the workpiece must be supported by a contacting engagement against its said surface portion, said method being characterized by:

A. during application of said material and fusion of the same, supporting the workpiece on rotatable supporting means which has limited contact with said surface portion of the workpiece and which, upon being rotated, can impart relative motion to the workpiece whereby the location of said limited contact is caused to move over said surface portion; and B. during fusion of the material and for a period thereafter during which the fused material solidifies to substantial hardness 1. rotating said supporting means to effect constant change in the location of said limited contact, and 2. cooling said rotatable supporting means to maintain the temperature thereof below the fusion temperature of said material, thus preventing the material from adhering to the rotatable supporting means.

5. A method by which a workpiece that has a substantially arcuate surface portion can be provided with a coating of a plastic material which is initially in the form of a heat fusible finely divided solid and which, after fusion, hardens under the influence of continued heat application, said coating covering the whole of said surface portion of the workpiece and being unbroken and unblemished notwithstanding that the workpiece must be supported by an engagement against its said surface portion while the plastic material is fusing and hardening, said method comprising:

A. heating the workpiece to a temperature at which said material in its initial form fuses;

B. placing the workpiece on a rotatable supporting means which has only limited contact with said surface portion of the workpiece and which can impart relative motion to the workpiece by reason of such contact therewith and its own rotation;

C. applying said material in its initial form on the heated workpiece, to cause the material to be fused into a coating on the workpiece by the heat thereof; and D. during the time that said material is fusing on the workpiece, and for a period thereafter during which the fused material solidifies to substantial hardness, 1. rotating said rotatable supporting means to constantly bring different parts of the coating on said surface portion of the workpiece into and out of contact with the rotatable supporting means, and 2. cooling said rotatable supporting means to maintain the temperature thereof below the fusion temperature of said material, thereby preventing the material from adhering to the rotatable supporting means.

6. The method of claim 5, wherein the rotatable supporting means is a tubular member, further characterized by:

cooling said tubular member by circulating through it a fluid heat absorbing medium.

7. The method of claim 5, wherein the rotatable supporting means comprises an elongated substantially cylindrical member of good heat conducting material that is rotatable about its own axis, and further characterized by:

cooling said cylindrical member by abstracting heat from one end thereof.

8. The method of claim 6, wherein said tubular member has a cantilevered support at one of its ends and is unsupported at its other end, and wherein the circulation of fluid heat absorbing medium through said tubular member is effected by:

forcing gaseous carbon dioxide into its supported end.

9. In the art of coating workpieces with heat fusible and heat curable plastic material that is initially in finely divided solid form, wherein such material is deposited onto a workpiece while the latter is at an elevated temperature such that the deposited material adheres to the workpiece and fuses thereon and the deposited material is cured to substantial hardness by its continued subjection to heat for a time after its fusion, that improvement by which an unbroken and unblemished coating can be obtained on a surface of the workpiece even though support of the workpiece during the time of deposition, fusion and curing of the plastic material requires a contacting engagement against its said surface, which improvement is characterized by the steps of:

A. supporting the workpiece on substantially round supporting means making only limited contact with said surface of the workpiece and which supporting means is rotatable about its own axis; and B. during the time that the plastic material is subjected to heat for fusion and curing, and until said material on the workpiece has attained substantial hardness, 1. by constantly rotating the supporting means, maintaining said workpiece in motion relative to said supporting means and thereby constantly shifting the location of said limited contact over said surface, and 2. cooling the supporting means to maintain it at a temperature below that at which the plastic material fuses.

10. In the art of coating workpieces with heat fusible and heat curable plastic material that is initially in finely divided solid form, wherein such material is deposited onto a workpiece while the latter is at an elevated temperature such that the deposited material adheres to the workpiece and fuses thereon and the deposited material is cured to substantial hardness by its continued subjection to heat for a time after its fusion, that improvement by which an unbroken and unblemished coating can be obtained on a surface of the workpiece even though said surface must have contacting engagement with supporting means during a time prior to the attainment of substantial hardness by such material on said surface, which improvement comprises:

A. during said time supporting the workpiece on supporting means having a substantially rounded surface, and by rotating the supporting means producing a substantially rolling and constantly shifting contacting engagement between the workpiece and said supporting means; and B. meanwhile maintaining the supporting means at a temperature below that at which the plastic material fuses.

* * * * *